United States Patent [19]

Sakata

[11] Patent Number: 4,696,041

[45] Date of Patent: Sep. 22, 1987

[54] APPARATUS FOR DETECTING AN UTTERANCE BOUNDARY

[75] Inventor: Tomio Sakata, Tokyo, Japan

[73] Assignee: Tokyo Shibaura Denki Kabushiki Kaisha, Kawasaki, Japan

[21] Appl. No.: 575,383

[22] Filed: Jan. 30, 1984

[30] Foreign Application Priority Data

Jan. 31, 1983 [JP] Japan ..... 58-13997

[51] Int. Cl.[4] ..... G10L 5/00

[52] U.S. Cl. ..... 381/46

[58] Field of Search ..... 381/46, 382

[56] References Cited

U.S. PATENT DOCUMENTS

| | | | |
|---|---|---|---|
| 4,277,645 | 7/1981 | May, Jr. | 381/46 |
| 4,535,473 | 8/1985 | Sakata | 381/46 |
| 4,597,098 | 6/1986 | Noso et al. | 381/46 |

FOREIGN PATENT DOCUMENTS

| | | |
|---|---|---|
| 58-130395 | 3/1983 | Japan . |
| 58-130393 | 3/1983 | Japan . |
| 59-9779 | 1/1984 | Japan . |
| 59-36300 | 2/1984 | Japan . |

OTHER PUBLICATIONS

"Discriminant and Least Squares Threshold Selection", Proc. 4th IJCPR (Kyoto), 1978, pp. 592–596.

*Primary Examiner*—Gareth D. Shaw
*Assistant Examiner*—John G. Mills
*Attorney, Agent, or Firm*—Cushman, Darby & Cushman

[57] ABSTRACT

An utterance boundary detecting apparatus of this invention includes an acoustic processor for generating speech parameter time sequence data according to an input speech signal. The speech parameter time sequence data generated from the acoustic processor is delivered to a buffer memory and noise level determining circuit. The noise level determining circuit calculates the average value of speech parameter values of a background noise corresponding to a silent period when a speech signal is input as words uttered. The apparatus includes a threshold value calculating circuit for calculating an utterance boundary detection threshold value on the basis of an average value calculated by the noise level determining circuit. An utterance boundary detecting circuit generates utterance boundary data on the basis of the threshold value from the threshold value calculating circuit and speech parameter time sequence data in a buffer memory.

3 Claims, 8 Drawing Figures

FROM AND 16
FROM TIMING CONTROL CIRCUIT 47
FROM A/D 10
FROM BUFFER MEMORY 102
18
20
ADDER
22
1/8
24
COMPARATOR
ER
26
8-SCALE COUNTER
30
C17
SPS
40
S R F.F
36
38
32
C17
C17
SPS
EPS
34
25-SCALE COUNTER
28
4-SCALE COUNTER
42
CPU
14
MULTIPLEXER
DATA BUS
46
ADDRESS COUNTER
FROM TIMING CONTROL CIRCUIT

APPARATUS FOR DETECTING AN UTTERANCE BOUNDARY

BACKGROUND OF THE INVENTION

This invention relates to an utterance boundary detecting apparatus for use in a speech recognition system.

In speech recognition systems, utterance boundaries are detected during pre-processing. Utterance boundary detection extracts utterance boundaries from a continuous speech signal. It is possible to relatively readily detect such utterance boundaries when the signal-to-noise (S/N) ratio is high (for example, a speech sound of above 30dB as an energy S/N ratio is treated) and the background noise level does not vary much.

A conventional utterance boundary detecting system extracts a speech sound (corresponding to words uttered) through a broad-band microphone and calculates the short-time energies and zero-crossing rate of extracted input speech signals. The utterance boundary is detected by determining the period in which the short-time energy and zero crossing rate continuously exceed their fixed threshold values for a predetermined time period.

In the detecting system using such fixed threshold values, if the background noise level varies time-wise to some extent, the following problem arises. If the fixed threshold value is set at a lower level, the background noise level will exceed the threshold level when it goes somewhat high, there being a disadvantage that the noise is taken as a part of an utterance boundary. If, on the other hand, the fixed threshold level is set at a higher level, it is not possible to extract a lower level speech signal during an utterance boundary. In order to solve such problem, a system is known which is adapted to detect an utterance boundary by determining a threshold value corresponding to the background noise level. That is, this system calculates each average value of the short-time energies and zero crossing rate of the input speech signal during a time interval which is regarded as a silent interval before the utterance of the speech signal, determines a threshold value obtained by adding a predetermined fixed bias value to the respective average value and detects the utterance boundary using such threshold value.

Even if this case, if a greater variation in the background noise level occurs, it is not possible to accurately detect the utterance boundary on the basis of such threshold value obtained. Now suppose that a fixed bias value is set at a lower level. In this case, the short-time energy and zero crossing rate exceed their threshold values and, as a result, noise intervals often occur. That is, the noise interval may occur as a part of the utterance boundary and/or only the noise interval may be detected as the utterance boundary, causing a seriously erroneous operation. If, on the other hand, the fixed bias value is set at a higher level, the portion or whole of the utterance boundary is dropped, causing an erroneous operation.

SUMMARY OF THE INVENTION

It is accordingly the object of this invention to provide an utterance boundary detecting apparatus which, even when a greater variation in a background noise level occurs, can accurately detect an utterance boundary by determining a threshold value including a proper bias value added.

The apparatus of this invention includes an utterance timing signal generating circuit for generating an utterance timing signal when a speech signal including a silent interval is input as words uttered. A speech parameters generator of this apparatus is adapted to sample the speech signal input according to the utterance timing signal and generate speech parameter time sequence data.

A noise level determining circuit of this apparatus calculates the average value of parameter values of a background noise corresponding to a silent interval when the speech signal is input and generates noise level data. A threshold value determining circuit calculates an utterance boundary detection threshold value including a predetermined bias value determined on the basis of the noise level data. An utterance boundary detecting circuit generates utterance boundary data including a start point and end point for utterance boundary determination on the basis of the utterance boundary detection threshold value and speech parameter time sequence data generated from the speech parameters generator.

A threshold value determining circuit can determine a threshold value including a proper bias value on the basis of the average value of the speech parameter values of the background noise. Even if the background noise level is high and greatly varies with time, the utterance boundary detecting circuit can accurately determine the start point and end point for utterance boundary determination on the basis of the above-mentioned threshold value. If the utterance boundary detecting apparatus of this invention is used, it is possible to improve the accuracy of the speech recognition processing of a speech recognition system.

DETAILED DECRIPTION OF THE PREFERRED EMBODIMENT

A utterance boundary detecting apparatus according to one embodiment of this invention will be explained below by referring to the accompanying drawings.

Figure 1:
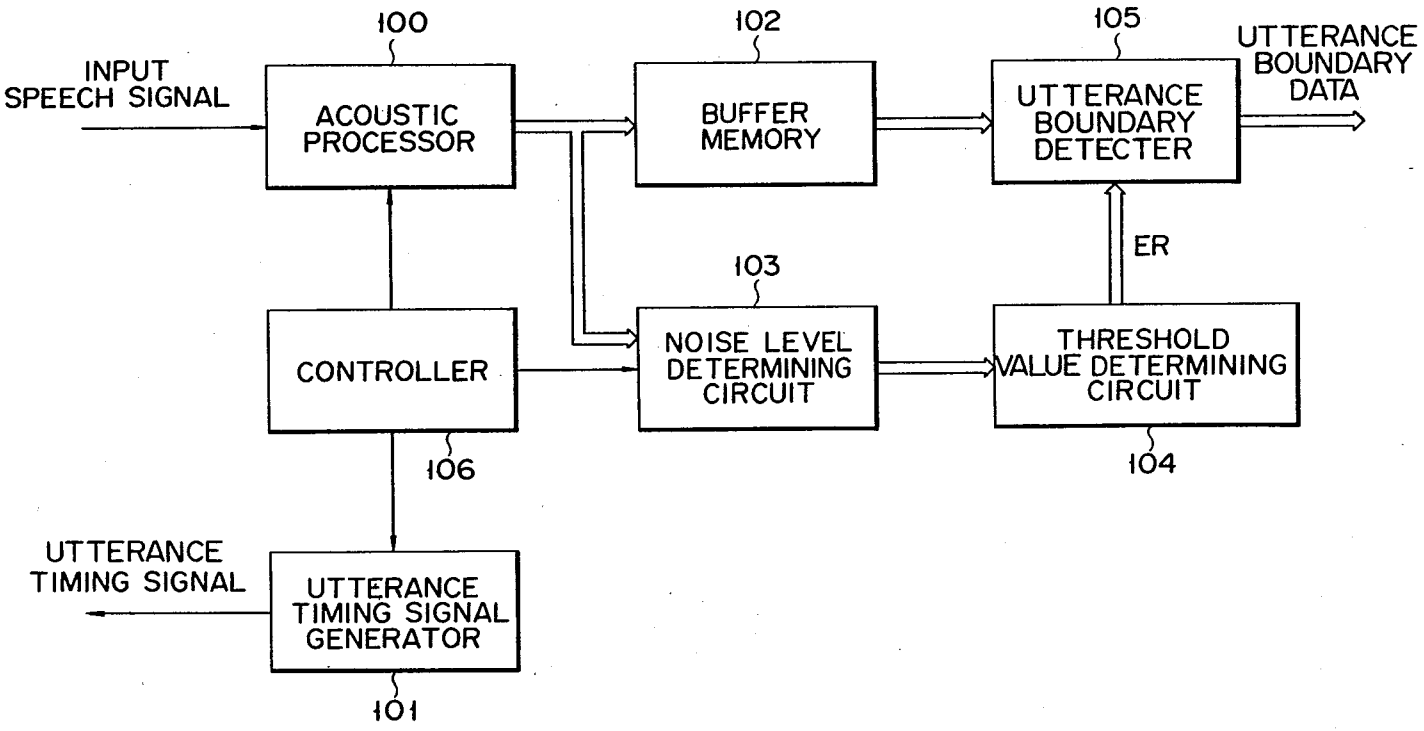
FIG. 1 is a block diagram showing an utterance boundary detecting apparatus according to this invention.
Figure 2:
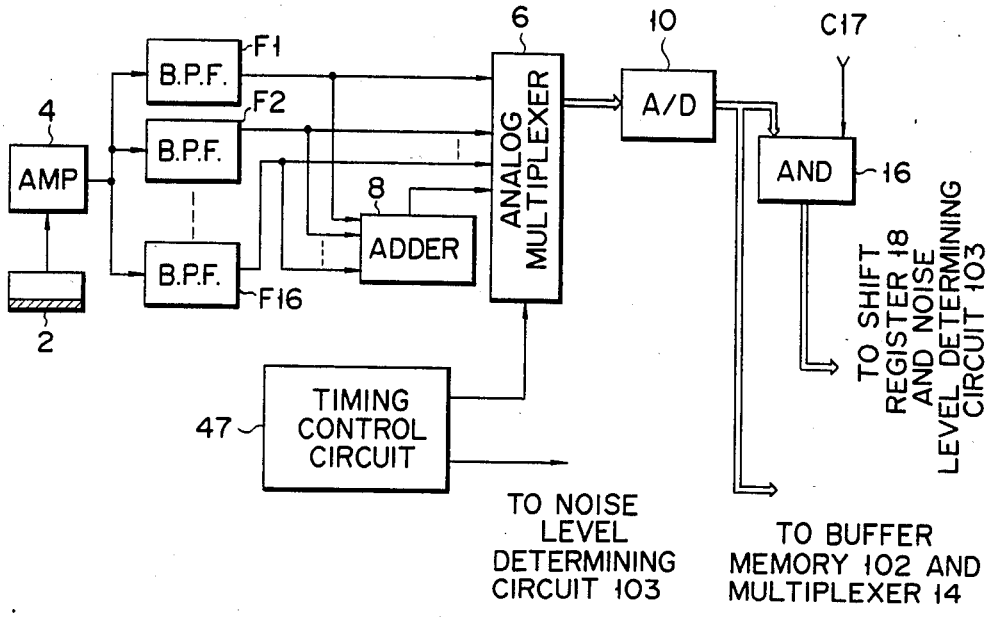
FIG. 2 is a circuit diagram showing an acoustic processor in FIG. 1.

FIG. 1 shows a circuit of the utterance boundary detecting apparatus according to one embodiment of this invention. A acoustic processor 100 as shown in FIG. 2 is adapted to acoustically analyze an input speech signal and generate speech parameter time sequence data. In this case, the speech parameter time sequence data is assumed to be the time sequence data of, for example, short-time energy data E. An input speech signal which is produced according to an utterance timing signal from an utterance timing signal generator 101 is delivered to the acoustic processor 100. A buffer memory 102 stores speech parameter time sequence data which is output from the acoustic processor 100.

The speech parameter time sequence data from the acoustic processor 100 is also supplied to a noise level determining circuit 103. The noise level determining circuit 103 calculates, on the basis of the speech parameter time sequence data, the average value of speech parameters in a silent interval which corresponds to a few frames immediately after the input speech signal starts to be supplied to the acoustic processor 100. The output of the noise level determining circuit 103 is supplied to a threshold value determining circuit 104. Here it is to be noted that one frame, i.e., a frame cycle, is of the order of 10 m sec. The threshold value determining circuit 104 delivers a threshold value ER for utterance boundary detection, which includes a bias value determined based on the average value of the speech parameters from the noise level determining circuit 103, to an utterance boundary detector 105.

The utterance boundary detector 105 is connected to produce, on the basis of the threshold value ER and speech parameter time sequence data from the buffer memory 102, utterance boundary data including a start point and end point for utterance boundary interval determination. A controller 106 as shown in FIG. 1 is comprised of a microprocessor and connected to control the starting and stopping operations of the utterance boundary detecting apparatus as a whole.

The acoustic processor 100 includes, as shown in FIG. 2, an electric/acoustic converting device 2, such as a broad-band microphone, for converting an acoustic signal to an electrical signal and 16 band-pass filters F1 to F16 for receiving a speech signal from the microphone 2 through an amplifier 4. The band-pass filters F1 to F16 have different frequency band widths sequentially varying from a low frequency region to a high frequency region. The output signals of the band-pass filters are supplied to an analog multiplexer 6 and adder 8. The output signal of the adder 8 is supplied as a 17-th input signal to the analog multiplexer 6. That is, the multiplexer 6 receives, in a parallel fashion, short-time-signals in the 16 frequency band widths in a range from the low to the high frequency region and short-time energy signal corresponding to the whole of the input speech signal. The output signals for each frame of the analog multiplexer 6 are serially supplied to an analog/-digital (A/D) converter 10 where they are converted to the corresponding short-time energy data $E_1$ to $E_{17}$. The output of the A/D converter 10 is fed to the buffer memory 102, multiplexer 14 and AND gate 16. The output of the AND gate 16 is supplied to, for example, an 8-stage shift register 18 and noise level determining circuit 103.

Figure 3:
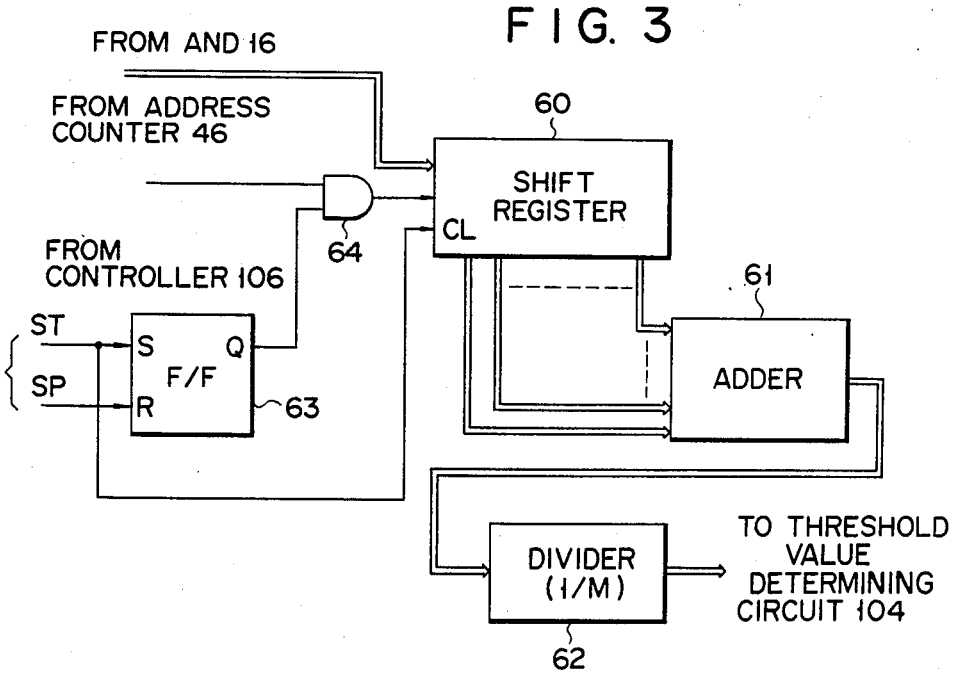
FIG. 3 is a circuit diagram showing a noise level determining circuit in FIG. 1.

The noise level determining circuit 103 includes, as shown in FIG. 3, a shift register 60, adder 61 and divider 62. The shift register 60 has its contents cleared when its clear terminal CL is supplied with a start signal ST which is produced from the controller 106 shown in FIG. 1. The start signal ST is also supplied to a set terminal S of a flip-flop 63. The flip-flop 63 is set upon receipt of the start signal ST and delivers an output signal from its Q terminal to one input terminal of an AND gate 64. The AND gate 64 delivers a load signal to the shift register 60 when the other input terminal thereof receives an output signal from a timing control circuit shown in FIG. 2. Upon receipt of the load signal, the shift register 60 stores the whole band short-time energy data $E_{17}$ which are fed from the AND gate 16 shown in FIG. 2. When a stop signal SP is supplied to the reset terminal R of the flip-flop 63 from the controller 106, the flip-flop 63 is reset, stopping a supply of the load signal to the shift register 60. As a result, the memory contents of the shift register 60 is held and later delivered to the adder 61. The adder 61 calculates a sum of the energy data corresponding to M frames in the shift register 60 and the output of the adder 61 is supplied to the divider 62. Here, the energy data corresponding to M frames means energy data in a silent time interval from the time at which the input speech signal starts to be supplied to the acoustic processor 100 to the time at which the M frames are involved (See FIG. 7). The divider 62 divides the output data of the adder 61 by M and the output of the divider 62 is supplied to the threshold value determining circuit 104, noting that the output of the divider 62 represents the average value of the speech parameters (short-time energy) in the silent interval.

Figure 4:
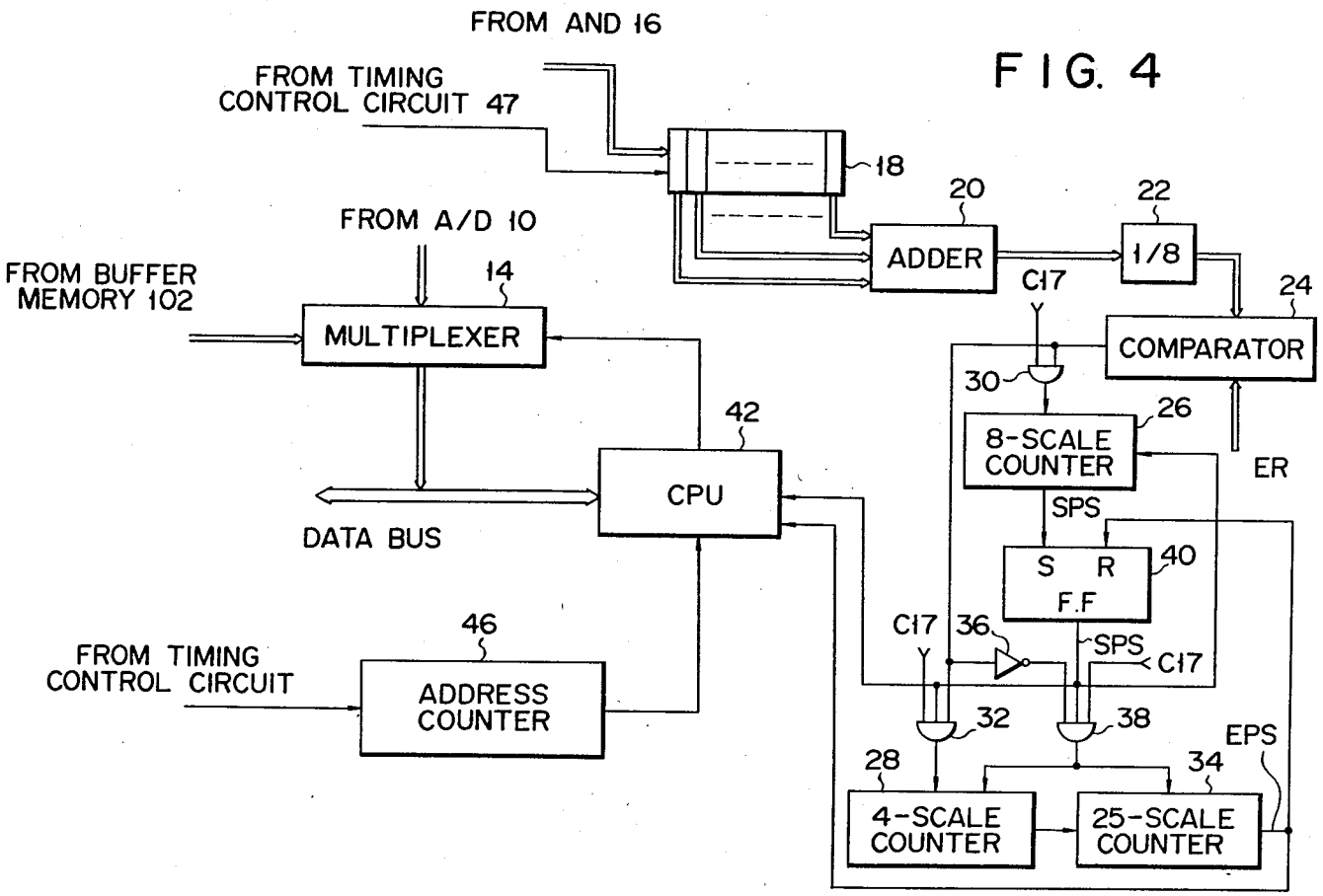
FIG. 4 is a circuit diagram showing an utterance boundary detecting circuit in FIG. 1.

FIG. 4 shows a detailed arrangement of the utterance boundary detector 105. As shown in FIG. 4, the utterance boundary detector 105 includes, for example, the 8-stage shift register 18 to which an output signal (speech parameter time sequence data) of the AND gate 16 as shown in FIG. 2 is supplied. The output data of the respective stages of the shift register 18 are added at an adder 20 and the output of the adder 20 is divided by a $\frac{1}{8}$ divider 22 into one-eighth parts. The output data of the $\frac{1}{8}$ divider 22 is compared by a comparator with a reference value ER. The value ER represents a threshold value which is output from the threshold value determining circuit 104 in FIG. 1. The output of the comparator 24 is coupled respectively through AND gates 30 and 32 to the up-count terminals of an 8-scale counter 26 and 4-scale counter 28 and through an inverter 36 and AND gate 38 to the reset terminal of the 4-scale counter 28 and up-count terminal of a 25-scale counter 34. The output terminal of the 4-scale counter 28 is coupled to the reset terminal of the 25-scale counter 34 and the output terminals of the 8- and 25-scale counters 26 and 34 are coupled to the set and reset terminals of a flip-flop 40, respectively. The output terminal of the flip-flop 40 is connected to a CPU (central processing unit) 42. The utterance boundary detector further includes an address counter 46 for counting the output pulses of the timing control circuit 47. The timing control circuit 47 produces 17 pulses in each frame of 10 m seconds. The 17 pulses occur in a period of, for example, a 1 m second so that a vacant period of 9 m seconds may be provided in each frame. The address counter 46 produces address data corresponding to its contents and a pulse signal C17 each time the 17-th pulse in each frame is counted.

The operation of the utterance boundary detecting apparatus as shown in FIG. 1 will be explained below.

Figure 7:
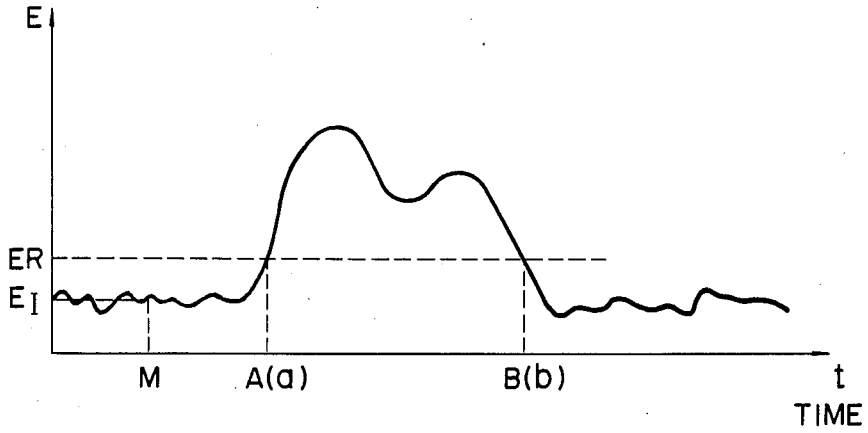
FIG. 7 is a waveform diagram showing a relation of the short-time energy of an input speech signal.

An utterance having a time series of energy as shown in FIG. 7 is supplied to the acoustic processor 100 in response to an utterance timing signal from the utterance timing signal generator 101. That is, an input speech signal is supplied to the broad-band microphone 2 shown in FIG. 2 and, after converted to an electric signal, delivered to an amplifier 4. The output signal of the amplifier 4 is supplied to the band-pass filters F1 to F16 which in turn smooth the input signal. The signal components having frequencies in the respectively allotted frequency band widths are supplied to the analog multiplexer 6 and adder 8. The output signal of the adder 8 is supplied to the analog multiplexer 6. In response to an output pulse from the timing control circuit 47, the analog multiplexer 6 sequentially produces short-time energy signals corresponding to output signals from the band-pass filters F1 to F16 and adder 8. The short-time energy signals are sequentially supplied to the A/D converter 10 which in turn supplies the corresponding digital energy data $E_1$ to $E_{17}$ as speech parameters to the buffer memory 102, multiplexer 14 and AND circuit 16. In this way, the acoustic processor 100 supplies the speech parameter time sequence data to the buffer memory 102.

On the other hand, the acoustic processor 100 supplies the speech parameter time sequence data to the noise level determining circuit 103. That is, as shown in FIG. 3, the output signal of the AND gate 16 is supplied to the shift register 60 where it is stored. The noise level determining circuit 103 is adapted to calculate an average value $E_I$ (FIG. 7) of speech parameter values in a range from the first frame (that is, the time at which the input speech signal starts to be supplied to the acoustic processor 100) to the M-th frame (for example, 80 to 100 m sec) through the operation of the adder 61 and divider 62. The average value $E_I$ is supplied to the threshold value determining circuit 104, noting that $E_I$ is regarded as the average value of the speech parameter values of background noises. An ordinary speech sound recognition system indicates the utterance timing to a talker and starts to receive an speech signal, i.e. the input speech signal, from the talker. However, the talker hardly utters words simultaneously with the issuance of the utterance timing signal, and makes utterances some time after the utterance timing signal has been output. For this reason, the time interval of about 100 m sec after the speech signal has started to be input is regarded as a silent interval. Thus, the average value $E_I$ is regarded as the silent interval, i.e., the average value of the speech parameters of the background noises.

Figure 6:
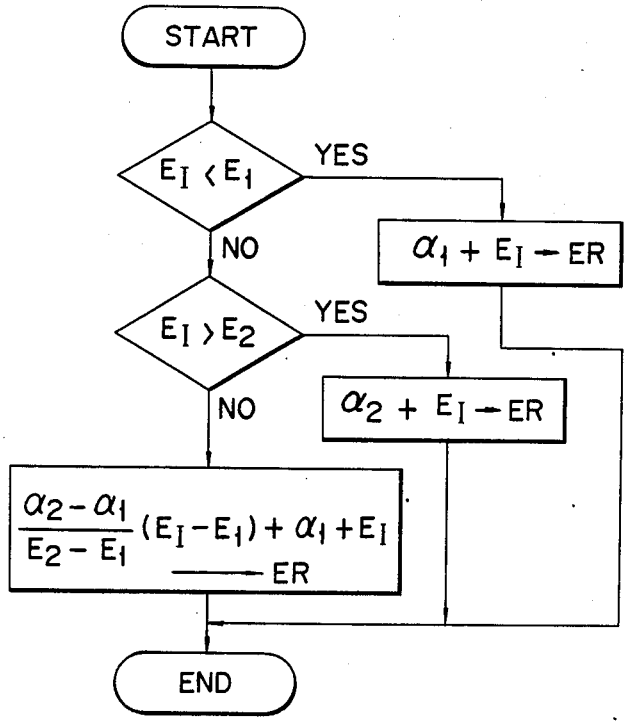
FIG. 6 is a flow chart showing an operation of a threshold value determining circuit in FIG. 1.
Figure 8:
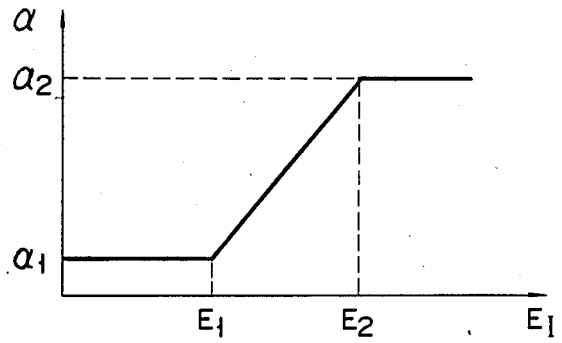
FIG. 8 is a characteristic diagram showing a relation of a speech parameter average value $E_1$ to a bias value $\alpha$ against a background noise.

The threshold value determining circuit 104 finds a bias value $\alpha$ from a average value $E_I$/bias value $\alpha$ relation of FIG. 8 on the basis of the average value $E_I$ of the speech parameters of the background noises and calculates a threshold value ER for utterance boundary detection as given by "$E_I+\alpha$". Stated in more detail, the threshold value determining circuit 104 comprises, for example, a microprocessor and is adapted to calculate the threshold value ER according to a flow chart shown in FIG. 6 and deliver an output to the utterance boundary detector 105. Here, the threshold value ER for utterance boundary detection is given by "$E_I+\alpha$" and thus a variation of the background noise level, even if it occurs, can be absorbed. That is, the variation in the background noise level includes a variation and dispersion of the short-time energy data. The variation of the average value is absorbed by $E_I$ in "$E_I+\alpha$" and the dispersion can be absorbed by properly setting the bias value $\alpha$. By varying the bias value $\alpha$ according to the average value $E_I$ as shown in the flow chart of FIG. 6 a proper threshold value ER for utterance boundary detection can be set even if a greater variation in the background noise level is involved. In FIG. 8, the values of $E_1$, $E_2$, $\alpha_1$, $\alpha_2$ are initially set on the basis of experiments conducted. In this case, the respective values of, for example, $E_1$, $E_2$, $\alpha_1$, $\alpha_2$ are set in a ratio of $E_1$: $E_2$: $\alpha_1$: $\alpha_2$=1: 8: 8: 16.

The utterance boundary detector 105 produces utterance boundary data, including a start point A and end point B for the utterance boundary of FIG. 7, on the basis of the threshold value ER calculated by the threshold value determining circuit 104 and speech parameter time sequence data read out of the buffer memory 102. That is, the utterance boundary detector 105 follows the time sequence of the short-time energy data E from the point of time at which the input speech signal starts to be input, and detects a point of time, a, corresponding to E>ER. The detector 105 examines whether or not the E>ER interval, i.e. the utterance boundary, continues over a time period corresponding to a predetermined frame number $N_1$, noting that $N_1$ corresponds to, for example, 40 to 80 m sec. The detector 105 produces an output with the point of time, a, as the start point A when the $N_1$ frame continuance conditions are satisfied. When at a time following the point of time, a, the E>ER interval does not satisfy the $N_1$ frame continuance conditions, the detector 105 regards the point of time, a, as being due to the noises and detects another point of time, a.

The detector 105 follows the speech parameter time sequence data from the start point A, detects a point of time, b, at which E≦ER, and examines, on the basis of the delected time point b, whether or not the E≦ER interval continues over a time period corresponding to a predetermined frame number $N_2$. In this connection it is to be noted that the frame number $N_2$ corresponds to, for example, 250 to 300 m sec. When the $N_2$ frame continuance conditions are satisfied, the detector 105 produces an output with the time point b as the end point B. When at the time point b et seq. an interval E>ER appears within the $N_2$ frame, if it does not reach a predetermined frame number $N_3$, it is regarded as a noise. Here, the frame number $N_3$ corresponds to, for example, 40 to 50 m sec. When, on the other hand, the interval E>ER continues up to and beyond the frame number $N_3$, it is regarded as the appearance of another utterance boundary and the detection of the time point b is newly effected. In this way, the utterance boundary detector 105 generates utterance boundary data including the start point A and end point B.

The operation of the circuit as shown in FIG. 4 will be explained below.

Figure 5:
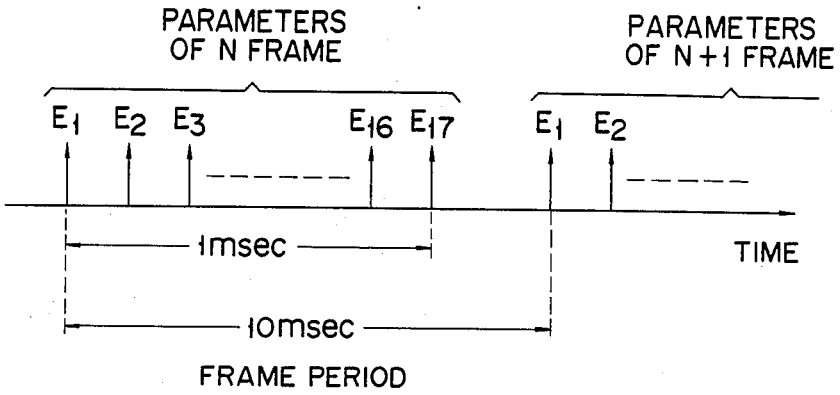
FIG. 5 is a timing chart showing the output of the acoustic processor.

First of all, the A/D converter 10 delivers digital energy data $E_1$ to $E_{17}$ as shown in FIG. 5 to the AND gate 16. The AND gate circuit 16 is enabled each time the address counter 46 produces a pulse signal C17, that is, each time a last pulse is produced in each frame from the timing control circuit 47. This causes the energy data $E_{17}$ corresponding to the output signal from the adder 8 (See FIG. 2) to be supplied to the 8-stage shift register 18 through the AND gate 16. The shift register 18 is driven in response to an output pulse from the timing control circuit 47 so as to shift energy data $E_{17}j$ to $E_{17}(j+7)$ produced in successive frames. The energy data $E_{17}j$ to $E_{17}(j+7)$ stored in the shift register 18 are added together in the adder 20 and divided by 8 in the $\frac{1}{8}$ divider 22 to produce a moving average $\hat{E}j$ for the energy data $E_{17}j$ to $E_{17}(j+7)$ as shown in FIG. 7. As is clearly seen from FIG. 7, a pulse noise having been included in the time series of energy is eliminated by taking the moving average. The moving average $\hat{E}j$ is compared with the reference value ER in the comparator 24 which produces a high level output signal upon detecting that the moving averag $\widehat{Ej}$ becomes equal to or larger than the reference value ER. As far as the moving average $\widehat{Ej}$ is smaller than the reference value ER, the flip-flop 40 is kept reset and all the AND gates 30, 32 and 38 are kept disabled.

Upon detecting that the moving average $\widehat{Ej}$ from the $\frac{1}{8}$ divider 22 becomes equal to the reference value ER, that is, the starting point A shown in FIG. 7 is reached, the comparator 24 produces a high level output signal to enabled the AND gate 30. The AND gate 30 permits a pulse signal C17 produced from the address counter 46 to be supplied to the 8-scale counter 26. When the 8-scale counter 26 counts eight pulses, that is, when the time point A is reached, it produces an output signal to set the flip-flop 40 which in turn produces a high level output signal SPS. In response to the high level output signal SPS from the flip-flop circuit 40, CPU 42 delivers a high level output signal to the multiplexer 14 so that energy data can be transferred from the buffer register 102 to CPU 42 through the multiplexer 14.

Upon detecting that the moving average Ej becomes smaller than the reference value ER, that is, an estimated end point B as shown in FIG. 7 is passed, the comparator 24 delivers a low level output signal to permit the AND gates 30 and 32 to be disabled and the AND gate 38 to be enabled through the inverter 36. This causes the 25-scale counter 34 to start the counting of C17 pulses supplied through the AND gate 8. When 25 pulses are counted, that is, the point B is reached, the 25-scale counter 34 delivers an output signal indicating that the utterance interval has been preliminarily determined by the points A and B. The output signal of the 25-scale counter 34 is supplied to CPU 42 and also to the flip-flop 40 to permit it to be reset. However, if the moving average larger than the reference value ER is detected after the point B has been detected, the counting of the 25-scale counter 34 is interrupted and the 4-scale counter 28 starts the counting operation. If, in this case, an output signal from the comparator 24 is kept at a high level for a period larger than a preset period, the 4-scale counter 28 continues to count the C17 pulses. Having counted four C17 pulses, the 4-scale counter 28 delivers an output signal indiciating that another utterance boundary appears in the same speech period, and resets the 25-scale counter 34. Thereafter, the same operation as described before is continuously effected so as to detect a preliminary end point of the utterance boundary. Where, however, an output signal from the comparator 24 is kept at a high level only for a short time period and the 4-scale counter 28 stops into counting operation before counting four pulses, the 4-scale counter 28 is reset and, at the same time, the 25-scale counter 34 starts its counting operation and supplies an output signal when the 25-scale counter 34 comes to have the contents of "25".

What is claimed is:

1. An apparatus for detecting an utterance boundary by comparing a speech signal with a threshold value generated in accordance with an average value of the speech signals in a predetermined period of time which begins immediately after inputting of the speech signal comprising:

utterance timing signal generating means for generating an utterance timing signal when a speech signal including a silent period is input as uttered words;

speech parameter generating means for receiving the speech signal which is input according to the utterance timing signal from said utterance timing signal generating means and generating speech parameter time sequence data;

noise level determining means for generating noise level data which is the average value of speech parameter values of a background noise corresponding to the silent period in a predetermined period of time which begins immediately after inputting of the speech signal generated in synchronism with the utterance timing signal from said utterance timing signal generating means on the basis of the speech parameter time sequence data output from the speech parameter generating means;

threshold value determining means for calculating based on the noise level data output from the noise level determining means, an utterance boundary detetion threshold value including a predetermined bias value which is variable in response to change in the average value of the speech parameter values; and utterance boundary detecting means for producing utterance boundary data including a start point and end point for determining an utterance boundary on the basis of the utterance boundary detection threshold value and speech parameter time sequence data generated from the speech parameter generating means.

2. An apparatus according to claim 1, in which said noise level determining means comprises memory means for storing said speech parameter time sequence data; adding means for calculating a sum of speech parameter values corresponding to a predetermined frame number from said speech parameter time sequence data when said speech signal is input; and dividing means for calculating said average value according to the result of calculation by the adding means.

3. An apparatus according to claim 1, in which said threshold value determining means comprises calculating means for calculating, as said utterance boundary detection threshold value, a value, which is obtained by adding a bias value to said average value, on the basis of said average value of said speech parameter values output from said noise level determining means, said bias value linearly varying in accordance with a variation of said average value.

* * * * *